United States Patent [19]

Yurko

[11] 4,009,114

[45] Feb. 22, 1977

[54] NON-PHOSPHATE DETERGENT COMPOSITION

[75] Inventor: Joseph A. Yurko, Bayonne, N.J.

[73] Assignee: Colgate-Palmolive Company, New York, N.Y.

[22] Filed: Oct. 3, 1975

[21] Appl. No.: 619,151

Related U.S. Application Data

[63] Continuation-in-part of Ser. No. 508,229, Sept. 23, 1974, abandoned, which is a continuation of Ser. No. 323,829, Jan. 15, 1973, abandoned.

[52] U.S. Cl. ..... 252/109; 8/137; 252/135; 252/539; 252/DIG. 11

[51] Int. Cl.[2] ..... C11D 1/22; C11D 3/08; C11D 3/10

[58] Field of Search ..... 252/108, 109, 121, 135, 252/539

[56] References Cited

UNITED STATES PATENTS

| | | | |
|---|---|---|---|
| 2,954,348 | 9/1960 | Schwoeppe | 252/109 |
| 3,590,001 | 6/1971 | Taylor | 252/135 |
| 3,629,121 | 12/1971 | Eldib | 252/89 |
| 3,692,684 | 9/1972 | Hentschel | 252/89 |
| 3,707,503 | 12/1972 | Kenny | 252/117 |
| 3,740,339 | 6/1973 | MacDonald | 252/135 |
| 3,749,675 | 7/1973 | Chang | 252/135 |
| 3,775,348 | 11/1973 | Jakobi | 252/524 |
| 3,783,008 | 1/1974 | Weldes | 117/100 A |
| 3,850,852 | 11/1974 | Neillie et al. | 252/536 |
| 3,892,680 | 7/1975 | Benjamin et al. | 252/532 |

*Primary Examiner*—P.E. Willis, Jr.
*Attorney, Agent, or Firm*—Steven J. Baron; Murray M. Grill; Herbert S. Sylvester

[57] ABSTRACT

A non-phosphate anionic detergent composition comprising an anionic sulfonate detergent, at least one soap, about 5 to 35% of a water-soluble salt mixture of alkali metal silicates, and alkali metal carbonates. These laundry products are suitable for use in cold water (e.g., 70°Fahrenheit).

10 Claims, No Drawings

NON-PHOSPHATE DETERGENT COMPOSITION

This application is a continuation-in-part of application Ser. No. 508,229, filed on Sept. 23, 1974 now abandoned, which is in turn a continuation of application Ser. No. 323,829, filed on Jan. 15, 1973, now abandoned, the benefit of which filing dates are claimed.

BACKGROUND OF THE INVENTION

1. Field of the Invention

This invention relates to non-phosphate built heavy duty laundry detergents. More particularly, this invention relates to a non-phosphate builder detergent utilizing a builder system comprising a citrate salt and mixture of an alkali metal silicate and an alkali metal carbonate.

2. Discussion of the Prior Art

Public awareness of the importance of improving the environment and avoiding disruptive effects on the ecology has been increasing greatly, and as a result thereof, widespread re-examinations of waste disposal methods have been undertaken. From various studies of our lakes, rivers, streams and ground waters, it has been concluded by some that ordinary household detergents, especially those comprising long lasting synthetic organic detergents and phosphate builders, have had detrimental effects on such waters. The surface active organic compounds which are not readily decomposed after discharge from the sink, wash tube or washing machine, may find their way into natural streams, creeks, rivers and lakes.

The major detergent manufacturers are endeavoring to remove from their products long lasting synthetic organic detergents, such as the highly branched alkyl aryl sulfonates, which are non-biodegradable, and have replaced these with comparatively easily degradable straight chain alkyl benzene sulfonates or similar materials which will be destroyed in a short time.

Because of the very desirable building, sequestering and soil-suspending activities of the polyphosphates, especially the alkali metal tripolyphosphates and pyrophosphates, it has previously been difficult to eliminate them from detergent compositions without significant losses in cleaning power. Even 100% active synthetic organic detergents have not been able to produce the same cleaning effect as is obtained from combinations of such compounds and polyphosphate(s). At the present time, about the only substitute in part for the polyphosphates which appears to be able to duplicate their effects substantially is nitrolotriacetic acid or a corresponding nitrilotriacetate, which are often referred to as NTA. However, recent laboratory tests and scientific studies have indicated that NTA might be a harmful factor as a cause of cancer and accordingly, there have been strict Government regulations prohibiting or limiting its use. Therefore, to overcome these deletorious effects on the environment caused by the use of phosphates and nitrogen compounds in laundry products, there is great activity in providing effective, safe and acceptable detergent compositions which do not contain phosphate or nitrogen compounds as a builder. The present invention is directed to such compositions.

BRIEF DESCRIPTION OF THE INVENTION

The detergents of this invention are based on a simple, inexpensive and commercially available anionic detergent, and a fatty acid or similar soap, all of which are readily biodegradable. In addition, the compositions contain no polyphosphates or other phosphate builder salts or any nitrogen compounds as builders, but use a mixture of alkali metal citrates, carbonates and silicates as builders. Briefly, the heavy duty detergent composition of the present invention comprises approximately from 10 to 20% of a linear alkyl aryl sulfonate (LAS), 5 to 20% of soap, 5 to 35% alkali metal citrate, 15 to 85% of a mixture of alkali metal carbonate and alkali metal silicates, 0 to 10% brighteners and other adjuvants and moisture.

OBJECTS AND ADVANTAGES

It is, therefore, the primary object of the present invention to provide a non-phosphate containing detergent composition which is a highly effective heavy duty detergent composition.

It is a further object of the present invention to provide a heavy duty detergent composition which is phosphate and nitrogen free and which is low foaming, non-yellowing and does not require the addition of anti-redeposition agents.

It is a still further object of the present invention to provide a heavy duty laundry detergent composition which can be utilized for all fabrics and at all temperatures, especially at low temperatures.

It is a still further object of the present invention to provide a heavy duty laundry detergent composition utilizing a biodegradable anionic sulfonate detergent and soap as the detergent base.

It is a still further object of the present invention to provide a detergent composition utilizing a mixture of an alkali metal silicate an alkali metal carbonate and an alkali metal citrate as a builder system.

Still further objects and advantages of the heavy duty laundry detergent composition of the present invention will become more apparent from the following more detailed description thereof.

DETAILED DESCRIPTION OF THE INVENTION

The foregoing objects and advantages are achieved through the composition of the present invention which comprises about 10 to 20% by weight of a linear alkyl aryl sulfonate having an average chain length of from between 10 and 16 carbon atoms, about 5 to 20% by weight of a soap selected from water soluble salts of higher fatty acids and resin acids, about 5 to 35% by weight of a water soluble salt of citric acid, and about 15 to 80% by weight of a mixture of alkali metal silicates and alkali metal carbonates. The above composition is a very effective heavy duty detergent possessing detersive properties substantially equal to or greater than conventional high phosphate and high nitrogen containing built heavy duty detergent compositions.

The detergent system of the composition of the present invention is a two-part detergent system, both parts of this detergent system being biodegradable. As a first component in the detergent system, the composition comprises about 10 to 20% by weight and preferably from 12 to 16% by weight, and most preferably about 14% by weight of an anionic higher alkyl aryl sulfonate; while the second component of the detergent system of the heavy duty detergent system of the present invention comprises from about 5 to 20% by weight, and preferably from about 8 to 15% by weight and most preferably, about 10% by weight of a soap which is a water soluble salt of a higher fatty acid or resin. By utilizing the detergent system of the present invention, a heavy duty detergent composition which contains completely biodegradable materials can be formed.

Suitable synthetic anionic detergents for use as the first component of the detergent system of the composition of the present invention include the higher alkyl mononuclear aromatic sulfonates such as the higher linear alkyl benzene sulfonates containing from 10 to 16 carbon atoms in the alkyl group, i.e., the sodium salts of decyl, undecyl, dodecyl, tridecyl, tetradecyl, pentadecyl, or hexdecyl benzene sulfonate and the higher linear alkyl toluene, xylene and phenol sulfonates; alkyl naphthalene sulfonate, ammonium diamyl naphthalene sulfonate, and sodium dinonyl naphthalene sulfonate.

The preferred water soluble anionic detergent compounds are the ammonium and substituted ammonium (such as mono-, di- and triethanolamine), alkali metal (such as sodium and potassium) and alkaline earth metal (such as calcium and magnesium) salts of the higher linear alkyl benzene sulfonates, especially the alkali metal salts of the higher linear alkyl benzene sulfonates. The particular salt will be suitably selected depending upon the particular formulation and the proportions therein.

The sodium alkylbenzenesulfonate detergent (LAS) most preferably used in the composition of the present invention has a straight chain alkyl radical of average length of about 11 to 13 carbon atoms. Preferably, the alkyl benzene sulfonate has a high content of 3 (or higher) phenyl isomers and a correspondingly low content (well below 50%) or 2-(or lower) phenyl isomers; in other terminology, the benzene ring is preferably attached in large part at the 3 or higher (e.g. 4, 5, 6 or 7) position of the alkyl group and the content of isomers in which the benzene ring is attached at the 2 or 1 position is correspondingly low. One suitable type of such detergent is described in the U.S. patent to Rubinfeld U.S. Pat. No. 3,320,174.

The second component of the detergent system of the compositions of the present invention are the class of compounds known as the soaps, such as the water soluble salts of higher fatty acids or resin acids which are derived from fats, oils and waxes of animal, vegetable or marine origin. The soaps employed are usually alkali metal salts, e.g., sodium and potassium salts, of mixed higher fatty acids, such as the mixtures of acids obtained from natural animal and vegetable fats and oils. Such soaps will generally comprise a major proportion of saturated fatty acid soaps of chain lengths from 10 to 18 carbon atoms. The most preferred mixtures are obtained by blending tallow and coconut oil fatty acids or by making soap from mixed tallow and coconut oil charges. For the purpose of this invention, such soaps will usually be more than 50% tallow and preferably will be from 80 to 100% tallow, with the balance usually being coconut oil or substitute oil therefor. Other solubilizing cations may be employed to make the desired soaps, such as ammonia, triethanolamine, trimethylamine, and other lower amines and alkanolamines, the cation of the soap will generally be chosen to be compatible with the sulfonate detergent cation.

The citrate component of the present invention which comprises from 5 to 35% by weight and preferably from 15 to 25% by weight and especially about 20% by weight of the composition of the present invention may be supplied as citric acid or as a water-soluble citrate such as alkali metal, e.g. sodium potassium, lithium, etc; ammonium; amine; alkanolamine; etc. The citrate compounds may be used in anhydrous form in the form of hydrates of with the mono-, di-, or trihydrate salts, or mixtures thereof being suitable. The preferred citrate for use in the composition of the present invention is sodium citrate with the preferred sodium citrate being the dihydrate.

In addition to the citrate component, the composition of the present invention includes from about 15 to 80% by weight, preferably from about 45 to about 75% by weight, and most preferably about 50% by weight of a mixture of an alkali metal silicate and an alkali metal carbonate in a weight ratio of silicate to carbonate of 1:0.25–4, most preferably a weight ratio of 1:1–2 and most preferably a weight ratio of 1:1.5. It is within this range and weight ratio that the combined silicate/carbonate mixture produces the exceptional building properties of the composition of the present invention so that the heavy duty laundry detergent of the present invention may perform substantially as well as prior art heavy duty phosphate and nitrile built detergents.

The alkali metal silicate used in the builder mixture of the composition of the present invention has an $M_2O:SiO_2$ weight ratio of about 2:1 to 1:4 wherein M is an alkali metal selected from sodium, lithium and potassium with sodium being preferred. The preferred weight ratio of $M_2O:SiO_2$ is 1.6:1 to 1:3 with the most preferred being 1:2. The silicate may be supplied in powdered or granular form or as a liquid aqueous solution, and may be added to the crutcher mix used in spray-drying the product or may be post-added to the spray-dried detergent beads or part may be included in the crutcher mix and part may be post-added.

The second component of the builder mixture for use in the composition of the present invention, comprises an alkali metal carbonate especially sodium carbonate which may come from any suitable source of this material including dense and light soda ash. As stated above the alkali metal silicate and alkali metal carbonate are present within a range of from 15 to 80% and within a relative ratio of silicate to carbonate of from 1:0.25 – 4. It is within this range that the composition of the present invention provides excellent cleaning and whitening properties.

In addition to the primary components of the present invention, other adjuvants may be present in the laundry product to give it additional properties, either functional or aesthetic. Examples of such adjuvants include bactericides, e.g., tribromosalicylanilide, fungicides, dyes, pigments (water dispersible), preservatives, ultraviolet absorbers, fabric softeners, supplemental builders in very small amounts, and perfumes. Of course, such materials will be selected for the properties desired in the finished product and to be compatible with the other constituents thereof.

Although one may use a single brightener in the compositions of the present invention, it is generally desirable to use a mixture of these so as to have good brightening effects on cotton, nylons, polyesters and blends of such materials and to maintain brightening activity even in the presence of chlorine bleaches. A good description of the various types of optical brighteners suitable for obtaining these results is given in the article, *Optical Brighteners and Their Evaluation*, by Per S. Stensby, a reprint of articles published in *Soap and Chemical Specialties* in April, May, July, August and September, 1967, especially at pages 3–5 thereof.

The cotton brighteners are frequently referred to as CC/DAS brighteners and are derived from the reaction product of cyanuric chloride and the disodium salt of diaminostilbene disulfonic acid. The compounds generally differ with respect to substituents on triazine and aromatic rings. Bleach-stable brighteners are usually benzidine sulfone disulfonic acids, a naphthotriazolyl stilbene sulfonic acid or a benzimidazolyl derivative. Polyamide brighteners are generally either aminocoumarin or diphenyl parazoline derivatives and polyester brighteners, which are also useful on polyamides, may be naphthotriazolylstilbenes. The brighteners are normally present as their soluble salts but may also be added as the corresponding acids. The cotton brighteners usually comprise a major part of the brightener system and are generally accompanied by a minor proportion of an amide-polyester brightener. Among the brighteners that are used in the present systems are: Calcofluor White ALF (American Cyanamid); ALF-N (American Cyanamid); SOF A-2001 (CIBA); CWD (Hilton-Davis); Phorwhite RKH (Verona); CSL, powder, acid (American Cyanamid); CSL, liquid monoethanolamine salt (American Cyanamid); FB 766 (Verona); Blancophor PD (GAF); UNPA (Geigy); Tinopal RBS (Geigy); and RBS 200 (Geigy).

It is one advantage of the present invention that the use of a soap based composition provides a low sudsing detergent composition which does not require any anti-redeposition agents normally used in non-soap containing detergent products. It has been found that by the addition of the water soluble soap of a higher fatty acid or a mixture of such soaps to a detergent composition the foam can be regulated as desired so that little or no foam is produced while a high level of detergency is maintained.

Control of foam level is important when the operation of an automatic washing machine is considered. Most of the automatic washing machines utilized in the home are top-loading types, having tub capacities of from 15 to 18 gallons. Due to the agitator construction of these machines, and the fact that the tubs are open at the top, foam produced in the washing rises and does not interfere with washing of the laundry, as might be the case in horizontal axis or front-loading washing machines. Such machines are usually of lesser water capacity, being from 7 to 9 gallons on the average, and the greater proportion of laundry to wash water usually allows the use of less detergent to effect the same degree of washing, providing that there is no foam-lock preventing good contact of detergent solution and laundry. Although the foam may help to float off particulate soil in a top-loading automatic washing machine and although housewives have in the past associated good foaming with good detergency, in recent years it has been considered desirable to limit the amount of foam produced by heavy duty washing products.

The composition of the present invention will now be more fully illustrated by way of the following specific examples wherein all parts and percentages are by weight and temperatures in degrees Fahrenheit. It is understood that such examples are presented for purposes of illustration only and the present invention is in no way to be deemed limited thereto.

EXAMPLE 1

A non-phosphate soap-synthetic detergent based laundry composition is formulated specifically for use in low temperature, i.e., 70° F., washing. This soap based laundry product does not require the use of a curd dispersing surfactant or of an anti-redeposition agent.

14.0% Linear Alkyl aryl sulfonate
10.0% Colgate-Palmolive Soap Chip (80% tallow, 20% coco)
20.0% G.D. Sodium Silicate (Philadelphia Quartz Co.)
30.0% Sodium Carbonate (Baker Co.)
20.0% Sodium Citrate (Baker Co.)
0.9% Optical Brighteners
5.1% Moisture Using New Jersey tap water, containing about 100 parts per million, expressed as calcium carbonate, of magnesium and calcium hardness, the detergency of the composition of Example 1 is evaluated in comparison with a commercially available phosphate built detergent. Five fabrics are washed five times in a laboratory Tergotometer washing machine at 70° and 120° F. and 0.15% concentration of laundry product, to show initial cleaning and possible detergent soap yellowing. Each of the fabrics is stained with Piscataway Clay prior to washing.

Reflectance readings of the washed fabrics are taken after the first and fifth washing on a Gardner Colorgard Reflectometer. The results are expressed as Rd values (higher values = better reflectance and whiteness) and *b* values (indicating yellowness, lower *b* numbers = less yellowing) and shown on Table I.

Table I

1st wash 100 ppm. 0.15% Conc. Test Fabric Cloth at 70° F.

| | Example 1 | | | | Comparative Phosphate Detergent | | | |
|---|---|---|---|---|---|---|---|---|
| | Soiled Area | | Clean Area | | Soiled Area | | Clean Area | |
| Fabric | Rd | b | Rd | b | Rd | b | Rd | b |
| Dac/Cot. | 46.4 | −1.1 | 86.0 | −2.0 | 43.7 | −1.4 | 85.2 | −2.1 |
| Spun/Dac. | 57.7 | +2.3 | 83.9 | +3.4 | 42.6 | +1.2 | 85.2 | −2.9 |
| Spun/Nylon | 76.1 | +1.0 | 85.3 | +1.2 | 77.2 | +1.5 | 85.6 | −1.2 |
| Cotton | 40.4 | −1.3 | 87.3 | −2.7 | 41.0 | −2.7 | 87.5 | −3.9 |
| Wash/Wear | 56.1 | +0.9 | 86.4 | +0.6 | 54.7 | +0.4 | 86.6 | 0.0 |

5th Wash with added soil Test Fabric Cloth at 70° F.

| | | | | | | | | |
|---|---|---|---|---|---|---|---|---|
| 5th Wash with added soil Test Fabric Cloth at 70° F. | | | | | | | | |
| | Example 1 | | | | Comparative Phosphate Detergent | | | |
| | Soiled Area | | Clean Area | | Soiled Area | | Clean Area | |
| Fabric | Rd | b | Rd | b | Rd | b | Rd | b |
| Dac/Cot. | 64.2 | −1.9 | 85.7 | −2.5 | 51.3 | −1.9 | 85.4 | −2.5 |
| Spun/Dac. | 72.0 | +2.7 | 83.7 | +3.2 | 45.1 | +0.7 | 80.1 | +2.1 |
| Spun/Nylon | 84.8 | −1.5 | 86.4 | −2.3 | 85.2 | −0.7 | 86.4 | −1.1 |
| Cotton | 56.4 | −5.1 | 88.5 | −5.5 | 53.7 | −4.1 | 86.7 | −5.1 |
| Wash/Wear | 68.4 | −0.3 | 86.6 | −1.0 | 62.7 | −0.6 | 86.9 | −1.2 |
| 1st Wash 100 ppm. 0.15% Conc. Test Fabric Cloth at 120° F. | | | | | | | | |
| Dac/Cot. | 46.0 | −1.3 | 84.8 | −1.8 | 38.1 | −1.5 | 84.7 | −2.3 |
| Spun/Dac. | 57.7 | +2.5 | 83.4 | +3.4 | 35.0 | +1.0 | 79.6 | +2.7 |
| Spun/Nylon | 77.3 | −1.5 | 85.9 | −1.8 | 77.4 | −0.1 | 85.9 | −0.3 |
| Cotton | 46.1 | −2.3 | 87.7 | −3.7 | 39.4 | −2.9 | 87.7 | −4.6 |
| Wash/Wear | 54.7 | +0.9 | 87.0 | +0.8 | 52.8 | +0.5 | 86.0 | +0.4 |
| 5th Wash with added soil Test Fabric Cloth at 120° F. | | | | | | | | |
| Dac/Cot. | 59.6 | −2.1 | 85.2 | −2.5 | 46.0 | −2.1 | 83.5 | −2.7 |
| Spun/Dac. | 68.5 | +2.5 | 83.4 | 2.9 | 36.8 | 0.2 | 70.3 | 1.1 |
| Spun/Nylon | 84.9 | −3.6 | 86.5 | −4.0 | 85.0 | −2.0 | 86.5 | −2.3 |
| Cotton | 53.4 | −4.9 | 88.1 | −6.2 | 54.1 | −6.2 | 88.3 | −6.9 |
| Wash/Wear | 68.0 | −0.6 | 86.6 | −1.3 | 62.2 | 0.8 | 85.6 | −1.5 |

The test results show that:

1. At both washing temperatures, the composition improves Rd values of soiled area, and shows no build-up of yellowness with increased washes.

2. Results of the 5th wash indicate that washing temperatures do not materially affect the considerable superiority of the composition of Example 1 over the phosphate built detergent with Dacron/Cotton, Spun Dacron, and Wash and Wear fabrics. Detergency of the proposed formulation and the phosphate built detergent is essentially equivalent for both 70° and 120° F. washings, against Spun Nylon and Cotton.

EXAMPLES 5 – 13

Detergent formulations as shown in Table 2 are tested in accordance with the procedure of Example 1 in order to determine detersive properties and anti-yellowing characteristics. Each of the compositions performs adequately both with regard to cleaning ability and non-yellowing characteristics even subsequent to a fifth wash.

Table 2

| Component | Example No. 5 | 6 | 7 | 8 | 9 | 10 | 11 | 12 | 13 |
|---|---|---|---|---|---|---|---|---|---|
| Na linear $C_{11-13}$alkyl benzene sulfonate | 20 | 10 | 20 | — | 13 | 10 | 17 | | |
| K linear $C_{16-18}$alkyl benzene sulfonate | — | — | — | 14 | — | — | | 12 | 16 |
| Sodium Soap (80% tallow, 20% coco) | 5 | 20 | 20 | | 17 | 5 | | | 10 |
| Sodium Soap (70% tallow, 30% coco) | | | | 10 | | | 10 | 15 | |
| Sodium Citrate (anhydrous) | | | | | | 5 | | | |
| Sodium Citrate (monohydrate) | | | | | 25 | | | | |
| Sodium Citrate (dihydrate) | | 35 | 35 | 20 | | | 20 | | 27 |
| Sodium Citrate (trihydrate) | 30 | | | — | | | | 9 | |
| Sodium Silicate ($Na_2O : SiO_2 = 1.6 : 1$) | | | | 30 | | | | 30 | 15 |
| Sodium Silicate ($Na_2O : SiO_2 = 1 : 1$) | | | 5 | | 20 | | 30 | | |
| Sodium Silicate ($Na_2O : SiO_2 = 1 : 2$) | 20 | 25 | | | | 45 | | | |
| Sodium Carbonate | 25 | 10 | 10 | 30 | 20 | 35 | 17 | 30 | 25 |
| Moisture and Misc. Adjuvents | — | — | 10 | — | 5 | — | 6 | 4 | 7 |

EXAMPLE 2

The following detergent composition is formulated and tested according to the procedure of Example 1:

10.0% Na linear alkyl benzene sulfonate (average chain length 12 carbon atoms)
15.0% Soap (80% tallow, 20% coconut)
22.0% Sodium citrate dihydrate
32.0% Sodium silicate ($Na_2O/SiO_2 = 1/2$)
30.0% Sodium Carbonate
1.0% Optical Brighteners The above composition is equal or superior to the comparative phosphate detergents in cold (70° F.) and hot (120° F.) washes.

EXAMPLE 3

The following detergent composition is formulated and tested according to the procedure of Example 1:

12% Triethanolamine linear alkyl benzene sulfonate (average chain length 11.5 carbon atoms)
14% Soap (85% tallow, 15% coconut)
25% Sodium citrate dihydrate
22% Sodium silicate ($Na_2O/SiO_2 = 1:2.5$)
27% Sodium carbonate The above composition is equal or superior to the comparative phosphate detergents in cold (70° F.) and hot (120° F.) washes.

EXAMPLE 4

The following detergent composition is formulated and tested according to the procedure of Example 1:

19% Sodium Tridecyl toluene sulfonate
10% Soap (68% tallow, 32% coconut)
23% Sodium citrate anhydrate
17% Sodium silicate
34% Sodium carbonate
1% Optical brighteners The above composition is equal or superior to the comparative phosphate detergents in cold (70° F.) and hot (120° F.) washes.

EXAMPLE 14

Example 1 is repeated with the exception that the sodium citrate dihydrate is replaced with potassium hydrate. This detergent composition performs adequately having approximately equal cleaning characteristics as the detergent composition of Example.

EXAMPLES 15–15*a*

The detergent formulation of Example 1 is repeated with the exception that the sodium carbonate is replaced by potassium carbonate or lithium carbonate, respectively, with similar results.

EXAMPLE 16

Example 2 is repeated with the exception that the sodium silicate is replaced with potassium silicate having a $K_2O/SiO_2$ of 1:1. This detergent performs substantially the same as the detergent in Example 2.

While the composition of the present invention has been illustrated by way of the foregoing specification and specific examples, the same are for the purposes of illustration only and are in no way construed to be limiting the composition of the present invention which is properly defined in the following appended claims.

What is claimed is:

1. A detergent composition devoid of phosphate or nitrogen-containing builders comprising a. about 12–16% by weight of a linear alkyl aryl sulfonate having an average alkyl chain length of about 10 to 16 carbon atoms;
b. about 8–12% by weight of a soap selected from water-soluble salts of higher fatty acids or resin acids;
c. about 12–25% by weight of citric acid or a water-soluble salt of citric acid; and
d. about 45–75% by weight of a builder salt mixture of alkali metal silicates and alkali metal carbonates, wherein the ratio of silicate to carbonate is 1:0.25–4.

2. The detergent composition of claim 1, wherein a. said linear alkyl aryl sulfonate is a linear alkyl benzene sulfonate with an average alkyl chain length of about 11 to 13 carbon atoms;

b. said soap is selected from a water-soluble salt of a higher fatty acid having a chain length of from 10 to 18 carbon atoms;

c. said water-soluble salt of citric acid is selected from mono-sodium citrate, disodium citrate, trisodium citrate and mixtures thereof; and d. said builder salt mixture is a mixture of sodium silicate and sodium carbonate in a weight ratio of 1:0.25–4.0.

3. The detergent composition of claim 1 wherein said soap consists essentially of 80% salts of tallow and fatty acid and 20% salts of coconut oil fatty acid and said water-soluble salt of citric acid is sodium citrate dihydrate.

4. The detergent composition of claim 1, further including less than 10% of optical brighteners, other adjuvants, moisture and mixtures thereof.

5. The detergent composition of claim 1 consisting essentially of a. about 14% of said linear alkyl aryl sulfonate;

b. about 10% of said soap;

c. about 20% of said sodium citrate dihydrate;

d. about 30% of sodium carbonate, and about 20% of sodium silicate ($SiO_2/Na_2O$ =2); and e. about 6% moisture and optical brighteners.

6. The detergent composition of claim 1 wherein component (1) is the sodium salt, component (2) is the sodium salt, component (3) is citric acid or sodium citrate and component (4) is comprised of sodium silicate in admixture with lithium or potassium carbonate.

7. The detergent composition of claim 6 wherein component (4) is sodium silicate and a 50:50 mixture of lithium and potassium carbonate, the weight ratio of silicate to carbonate being about 1:0.25 to 4.0.

8. A method of laundering fabric comprising ashing said fabric with a composition as defined in claim 1.

9. A method as defined in claim 8 where said fabric is selected from the group consisting of cotton, nylon, polester and blends thereof.

10. A method as defined in claim 8 wherein said fabric is washed in water having a temperature of about 70°–120° F.

* * * * *